United States Patent [19]

Austin

[11] 4,248,901

[45] Feb. 3, 1981

[54] COMBINATION PACKAGE AND SLEEVE SUPPORT MEANS

[75] Inventor: John J. Austin, LaGrange, Ill.

[73] Assignee: Champion International Corporation, Stamford, Conn.

[21] Appl. No.: 115,020

[22] Filed: Jan. 24, 1980

[51] Int. Cl.[3] ..... B65D 71/00

[52] U.S. Cl. ..... 426/119; 206/499; 206/503; 206/821; 220/4 D; 229/DIG. 11; 229/41 C; 426/108; 426/110; 426/124

[58] Field of Search ..... 426/119, 120, 124, 111, 426/108, 110; 220/4 B, 4 E, 4 D; 229/DIG. 11, DIG. 3, 41 C, 41 D; 206/499, 503, 821

[56] References Cited

U.S. PATENT DOCUMENTS

| | | | |
|---|---|---|---|
| 1,683,542 | 9/1928 | Greenwood | 206/499 |
| 1,856,634 | 5/1932 | Hartig | 426/124 |
| 2,062,539 | 12/1936 | Vogt | 426/130 |
| 2,085,238 | 6/1937 | Towell | 229/41 D |
| 2,572,610 | 10/1951 | Gilbert | 229/41 D |
| 3,145,112 | 8/1964 | Boegershausen | 426/130 X |
| 3,292,810 | 12/1966 | Schechter | 220/4 E |
| 3,861,530 | 1/1975 | Calvert | 206/499 |

*Primary Examiner*—Steven L. Weinstein
*Attorney, Agent, or Firm*—Evelyn M. Sommer

[57] ABSTRACT

Two containers housing an expandable food product are placed in face-to-face juxtaposition and a sleeve complemental in shape to the exterior panels of the facing containers is wrapped around the containers to form a unitized package. The sleeve is bisected by a perforated score line which enables the sleeve to be separated into two pieces. Each piece has a linear and undulating edge wherein the sleeve half can be placed in a microwave oven on its linear edge to support one of the containers above the oven surface on the undulating edge enabling the microwave energy to be distributed along all surfaces of the container to heat the food product within the container.

4 Claims, 6 Drawing Figures

Fig. 1.
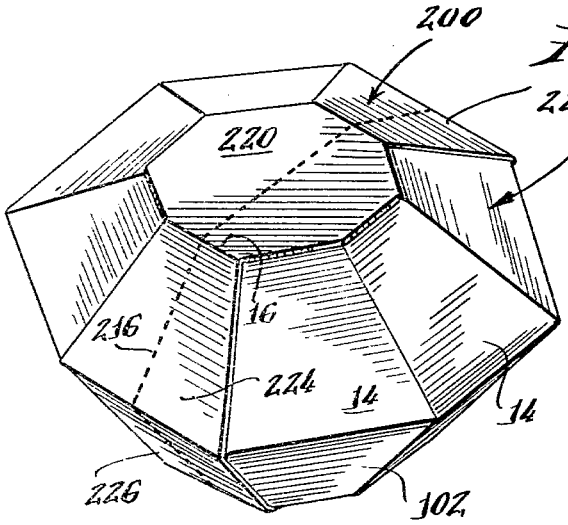
Fig. 2.
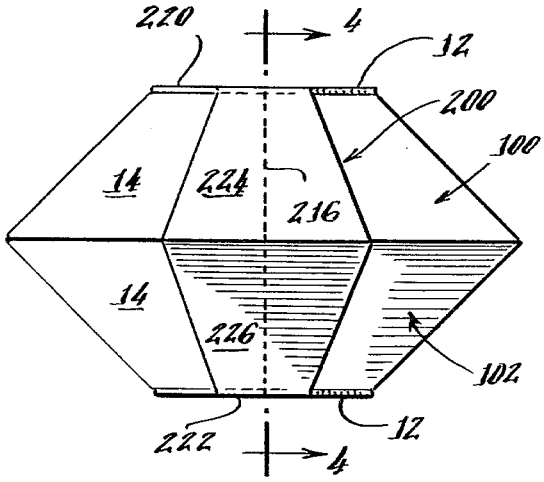
Fig. 4.
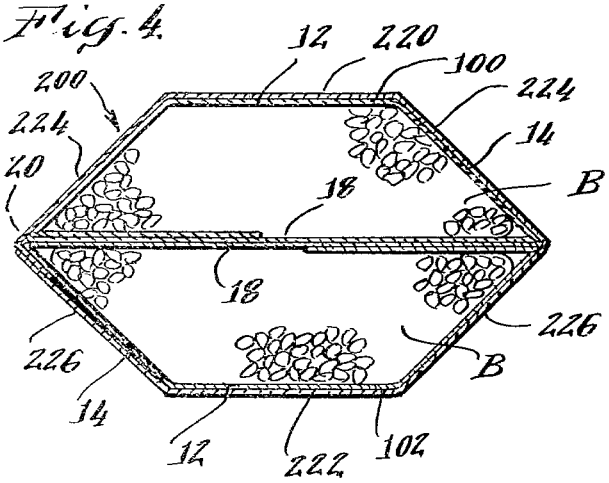
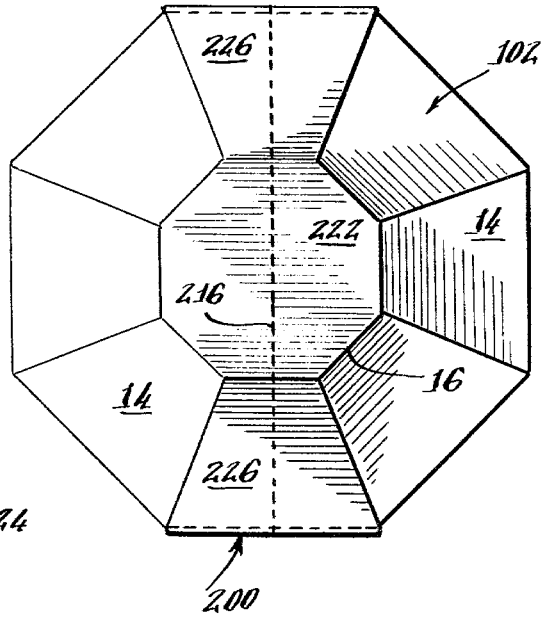
Fig. 3.
Fig. 5.
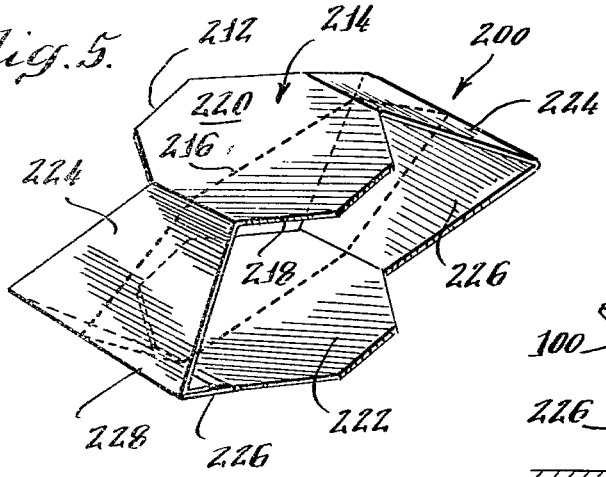
Fig. 6.
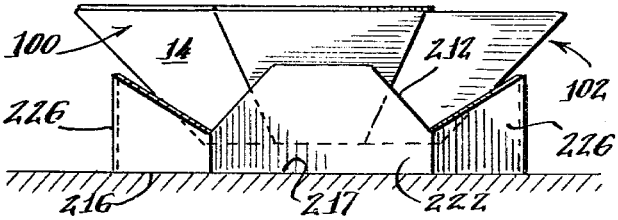

COMBINATION PACKAGE AND SLEEVE SUPPORT MEANS

BACKGROUND AND SUMMARY OF THE INVENTION

This invention relates to a novel expandable food package, and more particularly, the combination of an expandable food bag, a cooking container for housing the expandable food bag in an unexpanded, stored condition and in an expanded condition having a substantially increased volume, and a sleeve for holding a pair of the containers in face-to-face juxtaposition to form a unitized marketing package, the sleeve also functioning as a support for at least one of the containers in a cooking oven.

In our copending patent application Ser. No. 116911 entitled "EXPANDABLE FOOD PACKAGE CONTAINER", we disclosed a paperboard container for housing an expandable food bag or package in an unexpanded, stored condition and in an expanded condition having a substantially increased volume. Specifically, the food bag can contain corn kernels and cooking oil for forming popcorn, between a pair of round, overlapping, expandable polyethylene sheets, as disclosed in our copending patent application Ser. No. 116,910 entitled "PACKAGED EXPANDABLE FOOD".

The container, which forms no part of the present invention, consisted of a base portion in the shape of a regular polygon, preferably an octagon. Trapezoidal side panels extend outwardly and upwardly from the edges of the base portion and are foldably connected to an integral pop-up cover comprising a plurality of overlapped, separate semi-ovoid shaped top panels foldably connected to each of the side panels. One of the top panels includes a central, circular seal which is releasably attached to one of the remaining top panels to keep the cover closed. When the seal is removed, the semi-ovoid shaped top panels spring to an upright position to aid in housing the expanded food package, which is heated in a microwave oven.

This container is especially useful for heating and expanding food, such as popcorn, in a microwave oven since it is made of paperboard or a paperboard lamination, having no metallic elements or components to interfere with the absorption of the microwave energy and heat.

In our copending application Ser. No. 113757 entitled "CONTAINER UNITIZER SLEEVE AND SUPPORT", we disclosed a sleeve and fastener band used to retain a pair of the aforementioned containers in face-to-face relationship to form an integral package or unit which can be marketed as such. In other words, the sleeve serves as a package unitizer for a pair of identical containers which could be sold as a "twin-pack". Additionally, once the sleeve or band is disassembled from the container package and the container is ready for use in the microwave oven, the sleeve can be used to support the base portion of the container above the plane of the microwave oven walls enabling the base portion to be exposed to the microwave energy. This better distribution of microwave energy about the product increases the volume and quality of the expanded product.

The sleeve comprises a tube formed from an endless paperboard strip which can be separated along a central perforated score line into two pieces, each having a linear edge and an opposed undulating edge. The linear edge is provided by the perforated score line. The undulating edges of the sleeve constitute a series of peaks and valleys and at least one pair of opposed portions thereof are in the shape of a regular polygon complemental in shape to the polygonal shape of the base portion of one of the containers bound by the sleeve. The regular polygonal portions of the sleeve are connected by trapezoidal sections joined along a common base.

When a pair of containers are placed in face-to-face juxtaposition, they can be unitized in a single package by a binder sleeve which is slipped over and around the face-to-face containers. The regular polygonal portions of the sleeve seat on the base portions of the containers, while the trapezoidal portions are complemental in shape to and encompass the side walls of the container.

Once each band is removed and the containers are to be utilized in a microwave oven, the band is split along its central score line and the linear edge of one-half of the tubular sleeve is placed on the plane support surface of the microwave oven. The base portion of a container is then supported upon the undulating edge of the band half disposed above the plane surface of the oven so that the microwave energy can be distributed beneath the container for enhancement of the quality and volume of the cooked product.

This invention relates to the novel combination of the aforementioned components.

BRIEF DESCRIPTION OF THE DRAWINGS

Further objects and advantages of the invention will become apparent from the following description and claims and from the accompanying drawings wherein:

FIG. 1 is a perspective view of the composite, expandable food package of the present invention;

FIG. 2 is a side view in elevation of the food package of FIG. 1;

FIG. 3 is a top plan view of the food package of FIG. 1;

FIG. 4 is a cross-sectional view of the food package of the present invention taken substantially along the plane indicated by line 4—4 of FIG. 2;

FIG. 5 is a perspective view of a sleeve or band used to unitize the package of FIG. 1; and FIG. 6 is a side view in elevation of half of the sleeve of FIG. 5 used to support one of the containers of the food package above a plane surface.

DETAILED DESCRIPTION OF THE PREFERRED EMBODIMENT

Referring now to the drawing in detail, wherein like numerals indicate like elements throughout the several views, the expandable food package 10 of the present invention includes a pair of containers 100 and 102 in face-to-face juxtaposition. Each container 100 and 102 has a base portion including a bottom support panel 12 of a regular polygonal shape, preferably an octagon. The base portion further includes an upwardly and outwardly extending side wall panel 14 foldably connected to each edge 16 of said polygonally shaped bottom support panel 12. Each one of said side panels 14 is connected to an adjacent one thereof to form with said bottom support panel 12 a bowl-shaped base portion which is adapted to receive an expandable food bag B in stored condition, as shown in FIG. 4.

Containers 100 and 102 also include pop-up covers. The cover is adapted to enclose and store expandable food bag B in the bowl-shaped base portion of each container 100, 102 when closed and provide additional side support for the bag B when the bag is expanded in a microwave oven. Each cover comprises a plurality of overlapped, separate top panels 18 of generally semi-ovoid shape connected by a seal (not shown). Each panel has its lower edge 20 foldably connected to the top of one of the side panels 14.

The container 100 is formed from paperboard or a grease-resistant, specially chemically treated leak-proof paperboard lamination.

A binder sleeve 200 for holding the containers 100 and 102 together in face-to-face juxtaposition is illustrated in FIG. 5.

The sleeve 200 comprises an annular tube formed from an endless paperboard strip 214 having opposed undulating edges 212 and 218. A central, linear perforated score line 216 bisects strip 214 and is equidistant from edge 212 and 218. Endless paperboard strip 214 is inserted over a pair of containers 100 and 102 as indicated in FIGS. 1 to 4 to hold them together. Strip 214 is inserted around the container package 10 comprising the containers 100 and 102 which are placed in face-to-face juxtaposition.

Opposed panels 220 and 222 between the undulating edges 212 and 218 are shaped so as to conform to the regular polygonal-shaped bottom panel 12 of each container 100 and 102. In the embodiment illustrated, the panels 220 and 222 are octagonal in shape as are the bottom support panels 12 of each container 100 and 102, respectively.

Panels 220 and 222 are also chosen so as to be of a length to approximate the length of the side panels 14 of each of the containers 100 and 102 and also are complemental in shape thereto. In the example shown, the panels 224 and 226 are trapezoidal in shape and join along a common fold or score line 228.

After removal of the sleeve 200 from containers 100 and 102, the sleeve 200 can be separated into two pieces along perforated score line 216 and one half can be positioned in a microwave oven, as shown in FIG. 6, on a horizontal surface in contact with the linear edge 217 left by the score line 216, while the undulating edge 212 or 218 formed of the peaks and valleys provided by half of panels 220, 222, 224 and 226, can support one of the containers 100 or 102 above the floor of the oven. This permits better distribution of the microwave energy of the oven about the container, resulting in increasing the volume and quality of the cooked product to be held within the container.

What is claimed as new is:

1. A package comprising a pair of non-metallic containers placed in face-to-face juxtaposition, each container housing an expandable food bag in a non-expanded, stored condition, said bag capable of being in an expanded condition having a substantially increased volume, each of said containers including:

a base portion having a bottom support panel of regular polygonal shape, upwardly and outwardly extending side panels with a side panel connected to each edge of said polygonally shaped bottom support panel, each one of said side panels being connected to the adjacent one thereof to form with said bottom support panel a bowl containing an expandable food bag in store condition, and an integral cover enclosing and storing an expandable food bag in each of said bowls and providing additional side support for the bag when opened and the bag is expanded, the containers being positioned such that the covers of each of said containers is placed in face-to-face contact one upon the other, and a binder sleeve for holding the pair of said containers together as a unitized package in front-to-front juxtaposition and for supporting at least one of said containers above a plane surface when said containers are separated, said sleeve including:

a tube formed from an endless paperboard strip disposed around said containers holding said containers together; the tube having a pair of opposed undulating edges and a perforated score line bisecting the strip positioned equidistant from said undulating edges, an undulating edge of said strip providing a raised seat for one of said containers, when separated, above a plane surface when said strip is separated along said score line and supported on the edge formed by said perforated score line;

said endless paperboard strip including a plurality of panels joined to each other along common score lines and defined by the opposing undulating edges; some of said paperboard strip panels in said tube being in the shape of a regular polygon complemental to the shape of said bottom support panels of said containers whereas others of said paperboard strip panels being in the shape of said side panels.

2. The package of claim 1 wherein said polygonal shape is an octagon.

3. The package of claim 2 wherein said side panels of each container are trapezoidal in shape, one of the parallel edges of said trapezoidal side panel being connected to one of the edges of said octagonally-shaped bottom panel.

4. The package of claim 3 wherein at least some of said opposed panels of said sleeve are two trapezoidal panels joined along a common base.

* * * * *